US009605435B2

(12) United States Patent
Glick, Jr.

(10) Patent No.: US 9,605,435 B2
(45) **Date of Patent: *Mar. 28, 2017**

(54) Z-SHAPED CLOSURE MEMBER FOR RAISED SEAM ROOFS

(71) Applicant: Emanuel S. Glick, Jr., Morgantown, PA (US)

(72) Inventor: Emanuel S. Glick, Jr., Morgantown, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/058,851

(22) Filed: Mar. 2, 2016

(65) Prior Publication Data

US 2017/0037634 A1 Feb. 9, 2017

Related U.S. Application Data

(63) Continuation-in-part of application No. 14/819,246, filed on Aug. 5, 2015, now Pat. No. 9,359,767.

(60) Provisional application No. 62/046,949, filed on Sep. 6, 2014.

(51) Int. Cl.

| | |
|---|---|
| ***E04D 13/17*** | (2006.01) |
| ***E04D 11/00*** | (2006.01) |
| ***F24F 7/02*** | (2006.01) |
| ***E04D 1/30*** | (2006.01) |

(52) U.S. Cl.

CPC ..... *E04D 13/174* (2013.01); *E04D 1/30* (2013.01); *E04D 2001/305* (2013.01); *E04D 2001/309* (2013.01)

(58) Field of Classification Search

CPC ..... E04D 13/174; E04D 11/005; F24F 7/02; F24F 2221/52

See application file for complete search history.

(56) References Cited

U.S. PATENT DOCUMENTS

| | | | | |
|---|---|---|---|---|
| 5,427,571 A | | 6/1995 | Sells | |
| 5,605,022 A | | 2/1997 | Fulton | |
| 5,624,095 A | * | 4/1997 | Zissu | A47B 96/027 248/231.81 |
| 6,662,510 B2 | | 12/2003 | Rotter | |
| 7,788,857 B2 | | 9/2010 | Sprengler | |

(Continued)

FOREIGN PATENT DOCUMENTS

DE 9107785 U1 * 9/1991 ..... E04D 13/174

*Primary Examiner* — Rodney Mintz

(74) *Attorney, Agent, or Firm* — Miller Law Group, PLLC

(57) ABSTRACT

A Z-closure member for raised seam roofs is formed through bending techniques into a shape having a ventilated central vertical member, an upper mounting flange having a return upper retainer member terminating rearwardly of the central member, and a lower flange extending from said central member and terminating rearwardly thereof to define a cavity for the insertion of a filter against the central member. A plurality of filter retention devices are disclosed for restraining movement of the filter, including adhesive placed on said central opening, an upper tab integrally formed with said upper retainer member and extending downwardly therefrom, a flexible locking tab formed as a return from said lower flange and terminating at said cavity, and a raised retention dimple formed in the lower flange adjacent the cavity. An optional rearwardly and upwardly extending deflector member extends from said lower flange to deflect rain passing through the filter.

20 Claims, 15 Drawing Sheets

(56) References Cited

U.S. PATENT DOCUMENTS

| | | | | |
|---|---|---|---|---|
| 9,157,572 | B1 * | 10/2015 | Merideth | F24F 13/32 |
| 9,359,767 | B2 * | 6/2016 | Glick, Jr. | E04D 13/174 |
| D767,111 | S * | 9/2016 | Glick, Jr. | D23/386 |
| D770,028 | S * | 10/2016 | Glick, Jr. | D23/386 |
| 2001/0052207 | A1 | 12/2001 | Davis | |
| 2008/0318516 | A1 | 12/2008 | Rotter | |
| 2013/0344796 | A1 | 12/2013 | Rossetta | |
| 2014/0202093 | A1 * | 7/2014 | Knighton | E04D 13/174 52/198 |
| 2016/0069082 | A1 * | 3/2016 | Glick, Jr. | E04D 13/174 52/90.2 |
| 2016/0312474 | A1 * | 10/2016 | Knighton | E04B 7/02 |

* cited by examiner

Z-SHAPED CLOSURE MEMBER FOR RAISED SEAM ROOFS

CROSS-REFERENCE TO RELATED APPLICATIONS

This application is a continuation-in-part of U.S. patent application Ser. No. 14/819,246, filed on Aug. 5, 2015, and granted as U.S. Pat. No. 9,359,767, on Jun. 7, 2016, which claims domestic priority on U.S. Provisional Patent Application Ser. No. 62/046,949, filed on Sep. 6, 2014, the content of which is incorporated herein by reference.

FIELD OF THE INVENTION

This invention relates generally to the mounting of a vent cap on a raised seam roof, and more particularly, to a Z-closure member providing ventilation to a vent cap mounted on a raised seam roof in which the Z-closure member is formed with a filter retention features.

BACKGROUND OF THE INVENTION

Raised seam roofs are formed with U-shaped roof panels wherein the upright legs of the roof panels are joined to the upright legs of the adjacent roof panels to create a seam between adjacent roof panels. Precipitation is drained downwardly toward the roof line along the horizontal portion of the roof panel to keep the moisture away from the raised seam. At the peak of the roof structure, a vent cap is typically applied to cover the spaced between the opposing roof panels. The vent cap is typically secured to the roof panels by fasteners that connect the vent cap to a support member, which in turn is connected by fasteners to the individual roof panels. This support member can be in the shape of a Z having horizontal flanges that connect via fasteners to the vent cap and the roof panel, respectively, with a vertical flange interconnecting the horizontal flanges. The vertical flange can be formed with a plurality of openings to permit the passage of air from the outside the roof structure into the vent cap, or vice versa.

A Z-shaped support member is disclosed in U.S. Pat. No. 5,427,571, granted to Gary L. Selis on Jun. 17, 1995, in which the Z-shaped support member is connected to the roofing member by fasteners 68 extending through the lower horizontal flange, and to the vent cap member by fasteners 46 extending through the upper horizontal flange. The ventilation to the vent cap in the Selis patent is provided through corrugated material incorporated into the vent cap where the fastener 46 passes through the corrugated material to reach the upper horizontal flange of the Z-shaped support member.

A formed Z-closure member is disclosed in U.S. Pat. No. 5,605,022, issued on Feb. 25, 1997, to David A. Fulton to connect a vent cap to a specialized raised seam roof structure. The Fulton Z-closure member has a formed shape that includes an upper horizontal flange that is connected to the vent cap through fasteners 62. The Z-closure member has a lower horizontal flange that is connected to the roof panels through fasteners 60. The lower horizontal flange also includes a formed inner sidewall portion that extends upwardly and terminates in a lip that establishes a cavity that directs air flow in a particular manner through the vertical portion of the Z-closure member, which is formed with ventilation openings, then upwardly over the inner sidewall. The ventilation openings are covered by a screen that is trapped between integrally formed screen clamps on the back side of the ventilated vertical member.

In U.S. Pat. No. 6,662,510, issued on Dec. 16, 2003, to Martin J. Rotter, a roof ventilation strip is mounted to a raised panel roof structure where the vent cap would overlie the ventilation strip. The vent cap is connected to the raised seam portions by fasteners passing through the ventilation strip. The roof structure disclosed in U.S. Pat. No. 7,788,857, granted on Sep. 7, 2010, to Jeffrey Sprengler, et al, includes a Z-shaped support member positioned between the upright legs of the roof panel members. The Sprengler Z-shaped support member includes an upper horizontal flange that connects to a vent cap, but the lower horizontal flange further includes a formed wrap around portion that includes a hinge 14 that permits the wrap around portion to be positioned below the roof panel member. A fastener can then pass through the lower horizontal flange, through the roof panel member and then through the wrap around portion. The Sprengler Z-shaped support member does not teach the use of ventilation openings through the vertical member for the passage of air into the vent cap, although the lower horizontal flange is formed with openings for the passage of the fasteners to connect the Z-shaped support member to the roof panels.

U.S. Patent Application Publication No. 2001/0052207 of Robert Davis, published on Dec. 20, 2001, discloses a Z-closure member having an upper horizontal flange for connection to a vent cap and a lower horizontal flange for connection to a Z-shaped support member positioned between the upright legs of a raised seam roof structure. A vertical member interconnects the upper and lower horizontal flanges and is provided with ventilation openings for the passage of air from outside the roof structure to inside the vent cap.

Similarly, U.S. Patent Application Publication No. 2013/0344796 of Daniel Rossetta, published on Dec. 26, 2013, discloses a Z-closure member connecting a vent cap to a shingled roof structure. The Z-closure member is shown to have several configurations, but essentially consists of the upper and lower horizontal flanges for connection to the Z-closure member to the vent cap and to the roof structure, respectively. The vertical portion of the Z-closure member is formed with ventilation openings that allow for the passage of air through the Z-closure member into or from the vent cap.

It would be desirable to provide a formed Z-closure member for use with raised seam roof structures where the Z-closure member can be formed through conventional metal bending machines and provide structure for retaining a filter member without requiring specially formed clamps or other structure for retaining the filter against the vertical face of the Z-closure member.

SUMMARY OF THE INVENTION

It is an object of this invention to overcome the disadvantages of the prior art by providing a formed Z-closure member that provides structure for retaining a filter member without requiring specially formed clamps or other structure for retaining the filter against the face of the Z-closure member.

It is another object of this invention to provide a Z-closure member that can be formed by bending a single sheet of metal into the desired shape.

It is a feature of this invention that the formed shape of the Z-closure member accommodates the attachment of the Z-closure member to the roofing panels while accommodating the connection of a vent cap.

It is another feature of this invention that the Z-closure member has a lower flange that fits between the raised seams of the roofing panels of a raised seam roof.

It is an advantage of this invention that the lower flange of the Z-closure member can be attached to the body portion of a raised seam roof panel by fasteners extending through the lower flange and into the roof panel.

It is still another feature of this invention that the Z-closure member has an upper flange oriented in an opposing direction from the lower flange to affect mounting of the vent cap thereto.

It is another advantage of this invention that a vent cap formed with a connecting flange can be engaged with the upper flange of the Z-closure member without fasteners.

It is still another advantage of this invention that the attachment of the vent cap to the upper flange of the Z-closure member can be reinforced with the addition of fasteners extending through the connecting flange of the vent cap and the captured upper flange of the Z-closure member.

It is another feature of this invention that the lower flange is formed with a lower flexible locking tab that assists in retaining the filter in place against the central vertical member.

It is yet another feature of this invention that the lower flange can have an elastomeric seal secured to the bottom surface thereof to form a seal between the lower flange and the body portion of the roofing panel to which the Z-closure member is attached.

It is yet another advantage of this invention that the elastomeric seal will seal the insertions of fasteners through the lower flange into the body portion of the roofing panel.

It is a further feature of this invention that the central vertical member of the Z-closure member is formed with ventilation openings to allow the passage of air between the vent cap and the roof panel.

It is yet a further feature of this invention that the central vertical member can also be formed with weep holes to allow any moisture passing through the ventilation openings into engagement with the filter to drain from the Z-closure member.

It is still another object of this invention to provide a Z-closure member that provides ventilation between a vent cap and a raised seam roofing panel that is convenient to install.

It is yet another object of this invention to provide a Z-closure member for providing ventilation between a vent cap and a roofing panel, which is durable in construction, inexpensive of manufacture, carefree of maintenance, facile in assemblage, and simple and effective in use.

These and other objects, features, and advantages are accomplished according to the instant invention by providing a Z-closure member formed through bending a single sheet of sheet metal into a shape having a ventilated central vertical member, an upper mounting flange terminating in an upper tab member, and a lower flange member extending in an opposing direction from the upper mounting flange member and terminating in a flexible locking tab. The lower flange is secured to a raised seam roofing panel with fasteners, while the vent cap formed with a return lip is engaged with the upper flange by capturing the upper flange within the return lip. A fastener can be inserted through the vent cap return lip and the upper flange to secure the vent cap to the Z-closure member. A mesh filter is trapped against the vertical member by the upper tab member and the lower flexible locking tab. A seal can be added to the lower flange to seal against the roofing panel. A plurality of filter retention devices are disclosed for restraining movement of the filter, including adhesive placed on said central opening, an upper tab integrally formed with said upper retainer member and extending downwardly therefrom, a flexible locking tab formed as a return from said lower flange and terminating at said cavity, and a raised retention dimple formed in the lower flange adjacent the cavity. An optional rearwardly and upwardly extending deflector member extends from said lower flange to deflect rain passing through the filter.

BRIEF DESCRIPTION OF THE DRAWINGS

The advantages of this invention will become apparent upon consideration of the following detailed disclosure of the invention, especially when taken in conjunction with the accompanying drawings wherein.

DETAILED DESCRIPTION OF THE PREFERRED EMBODIMENTS

Figure 1:
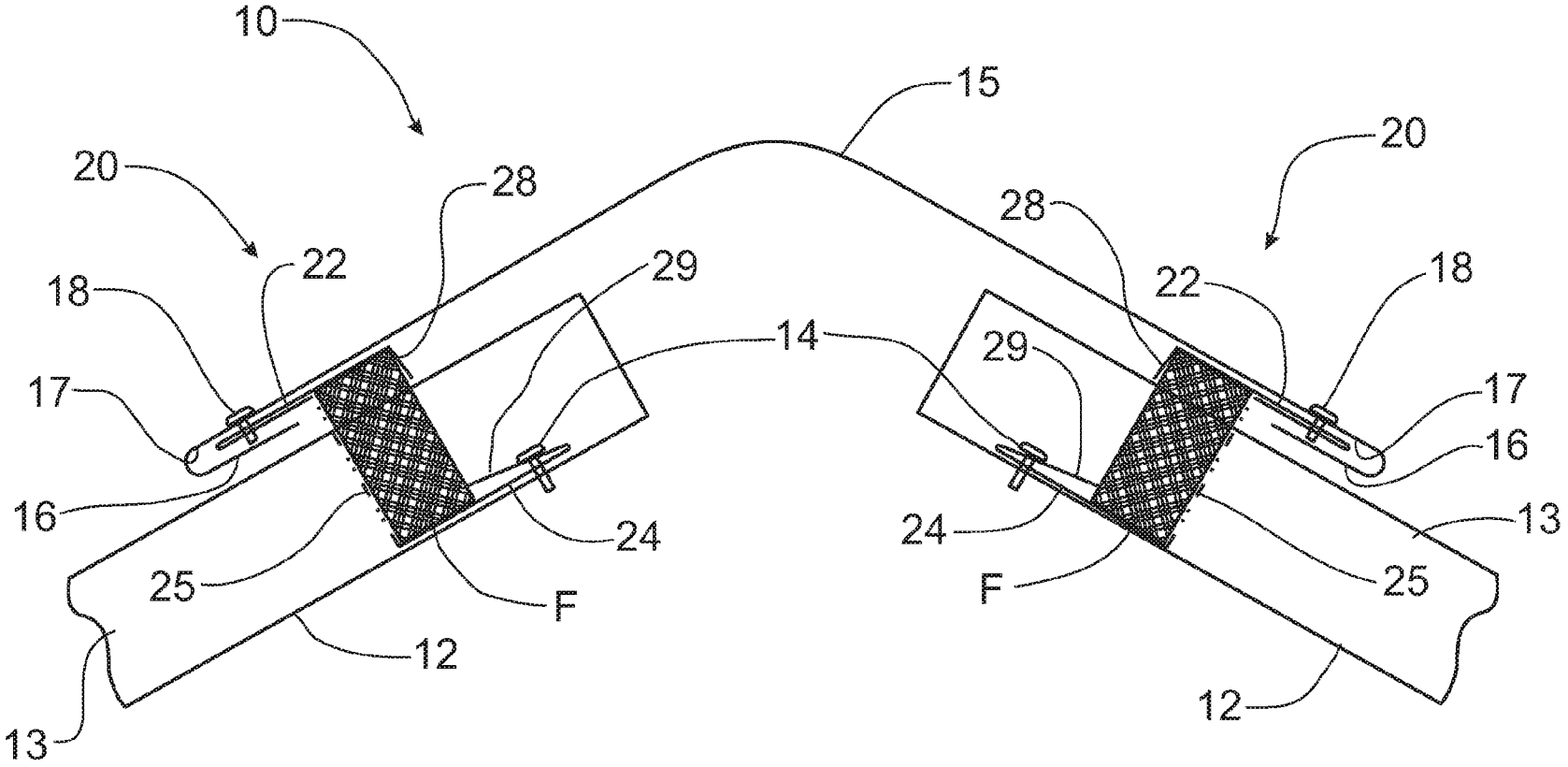
FIG. 1 is a schematic cross-sectional view of a vent cap mounted on a raised seam roof structure by Z-closure members incorporating the principles of the instant invention.
Figure 2:
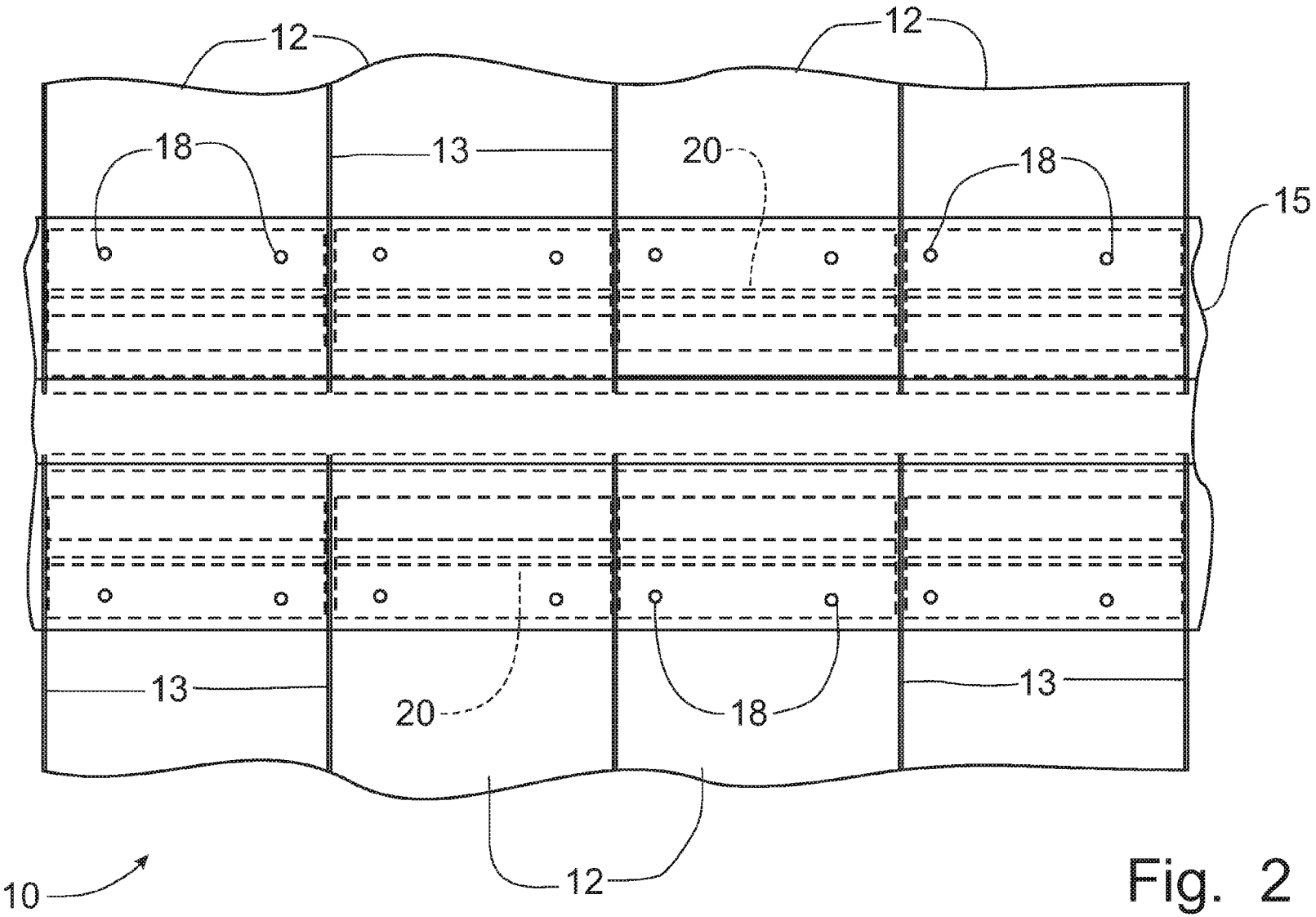
FIG. 2 is a partial schematic top plan view of a vent cap mounted on a raised seam roof structure as depicted in FIG. 1.
Figures 3, 4:
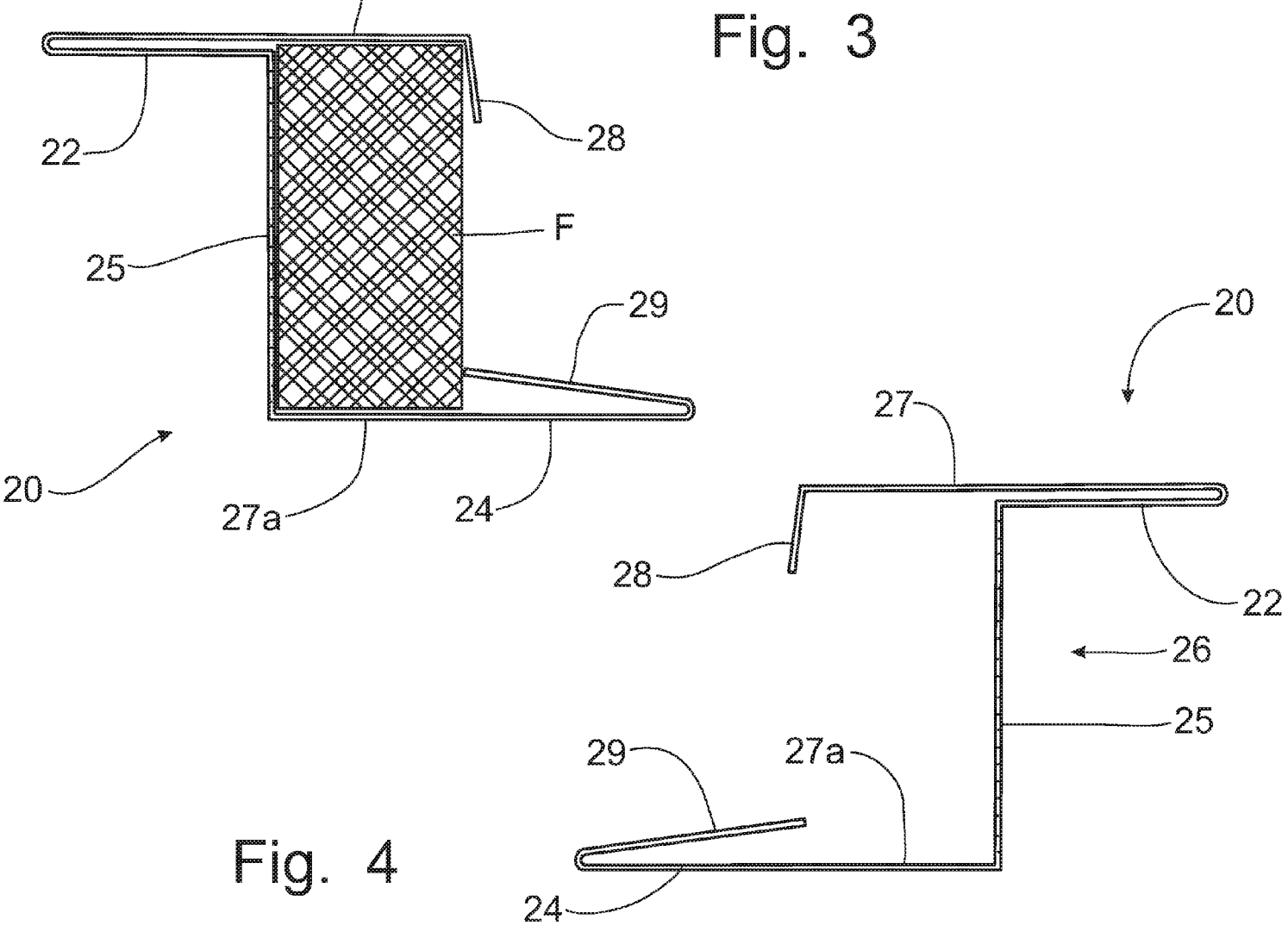
FIG. 3 is a schematic left elevational view of the Z-closure member incorporating the principles of the instant invention, a representative filter secured by the retention features of the Z-closure member being depicted.
FIG. 4 is a schematic opposing right end elevational view of the Z-closure member shown in FIG. 3 without the representative filter.
Figure 5:
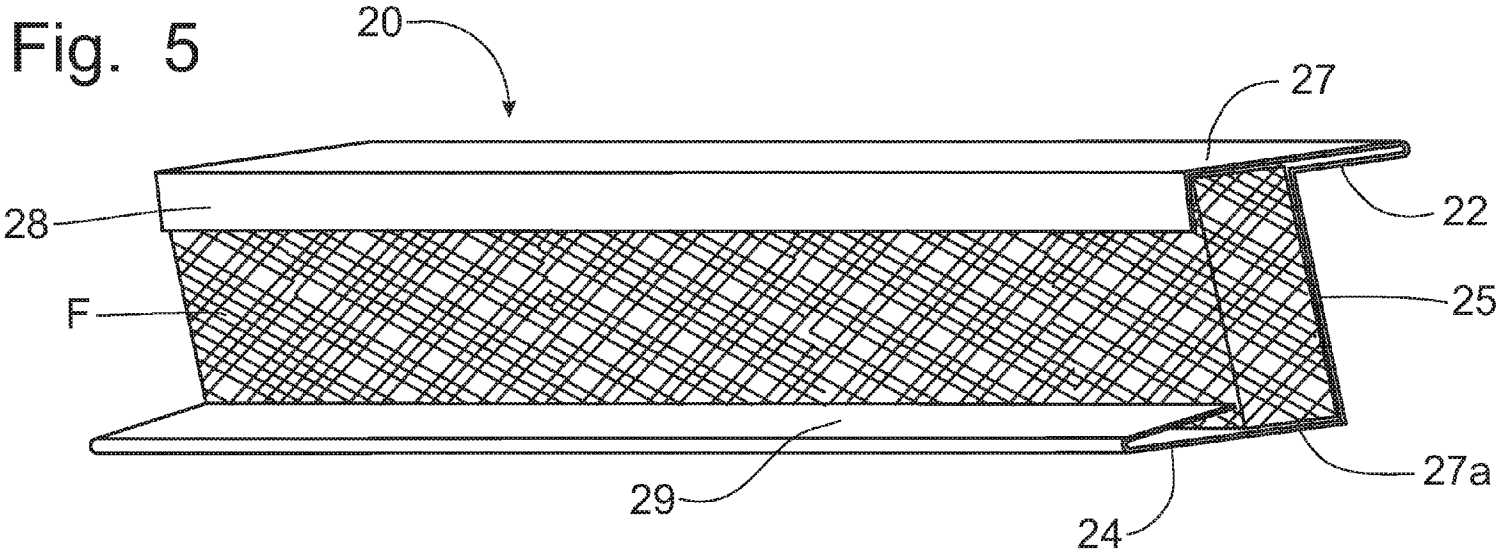
FIG. 5 is a schematic rear perspective view of the Z-closure member shown in FIG. 3 with a representative filter being depicted.
Figure 6:
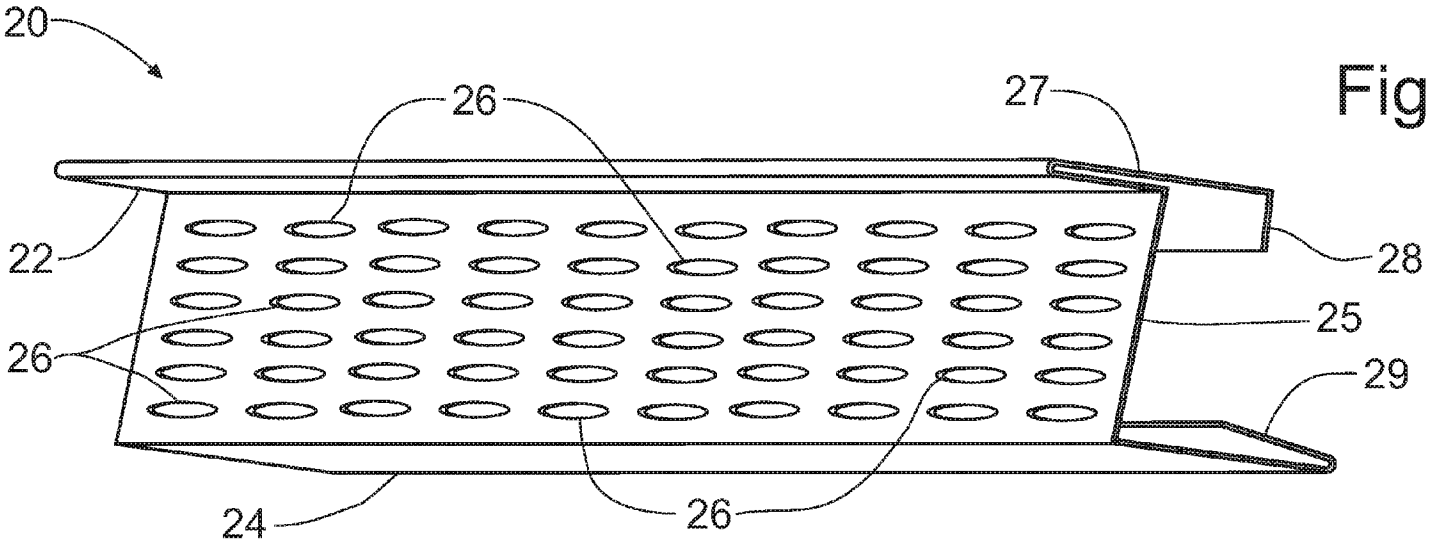
FIG. 6 is a schematic front perspective view of the Z-closure member shown in FIG. 3 without a representative filter.
Figure 7:
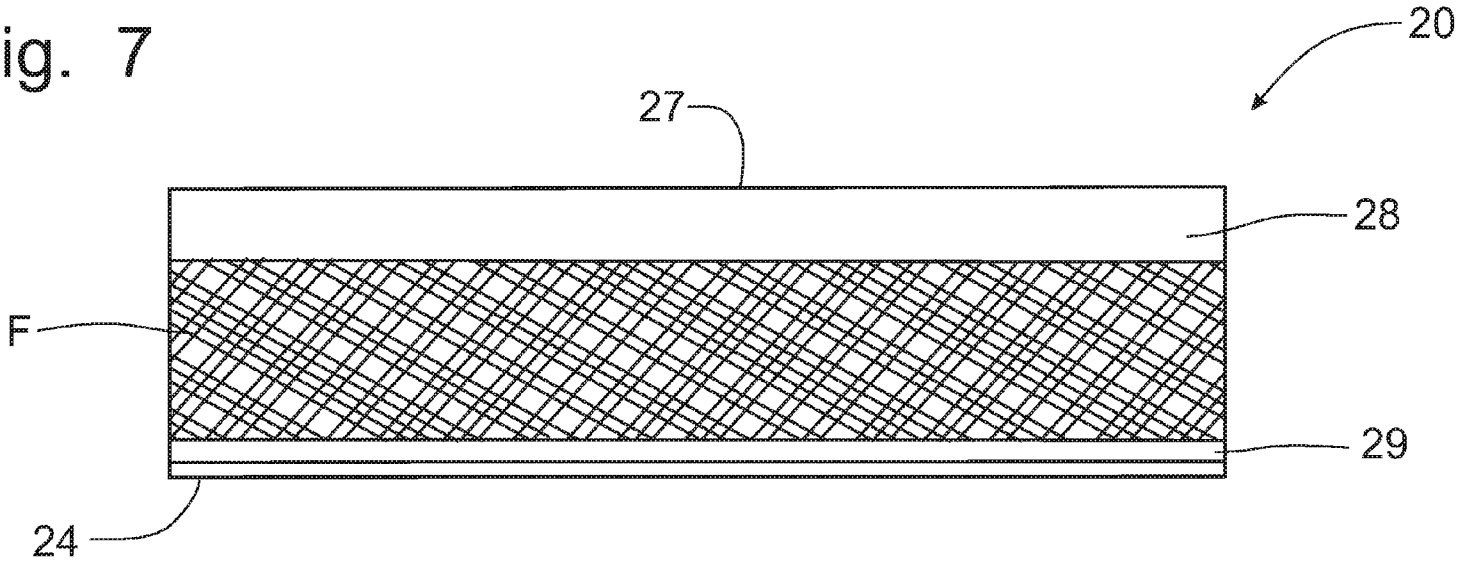
FIG. 7 is a schematic rear elevational view of the Z-closure member shown in FIG. 3 including a representative filter secured by the retention features of the Z-closure member.
Figure 8:
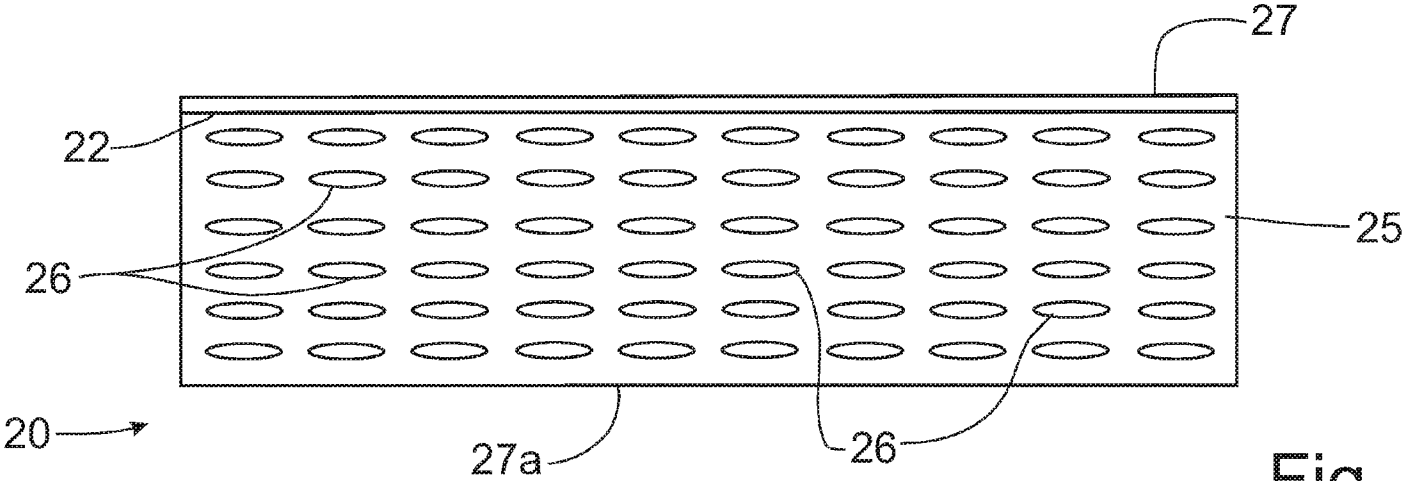
FIG. 8 is a schematic front elevational view of the Z-closure member shown in FIG. 3.
Figure 9:
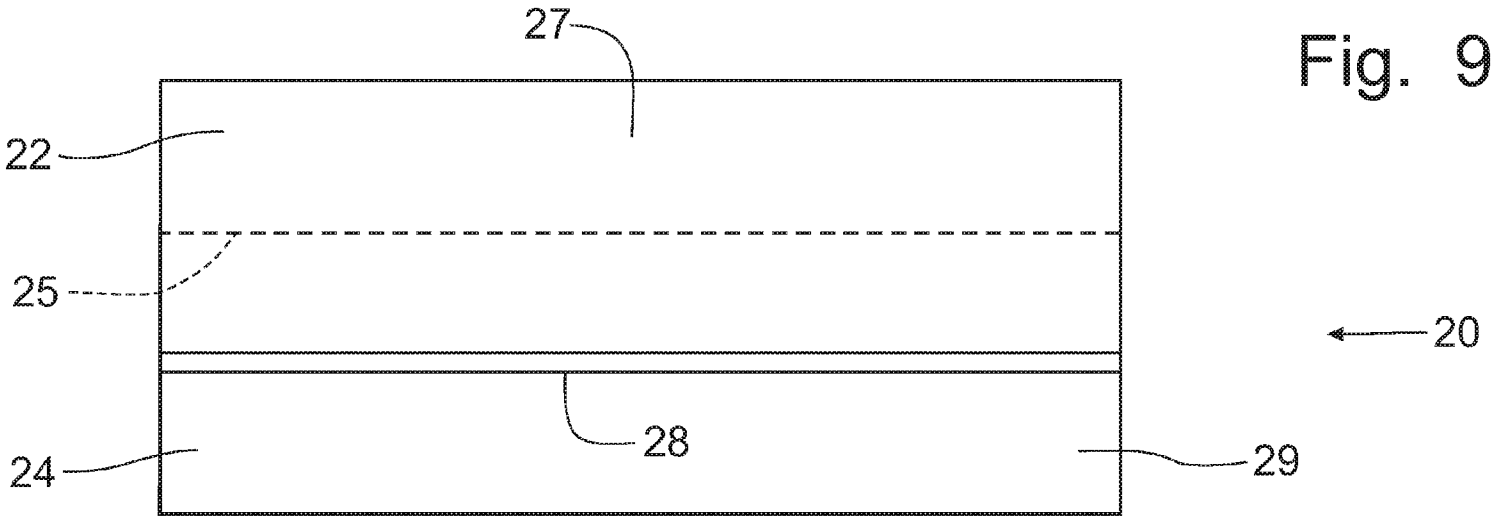
FIG. 9 is a schematic top plan view of the Z-closure member shown in FIG. 3.
Figure 10:
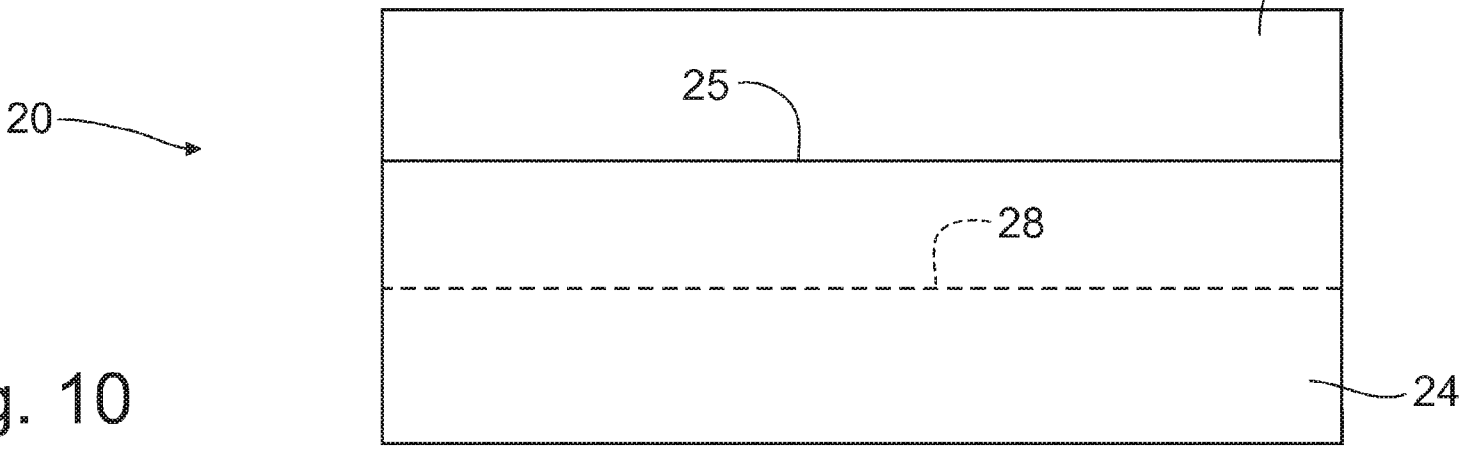
FIG. 10 is a schematic bottom plan view of the Z-closure member shown in FIG. 3.

Referring now to drawings, and particularly to FIGS. 1 and 2, the mounting of a vent cap to a raised seam roof structure utilizing a Z-closure member incorporating the principles of the instant invention can best be seen. References are made to front and rear, top and bottom, and can be determine by standing outside of the vent cap and looking at the front side facing the exterior of the roof structure. Thus, the top surface would be positioned adjacent to the vent cap, the bottom surface would be adjacent to the roof panels, and the rear surface would be facing the interior of the vent cap. References herein to horizontal and vertical are made with the Z-closure member being supported on a horizontal plane, although the typical placement of the Z-closure member to mount a vent cap to a raised seam roof orients the Z-closure member at an angle to a horizontal plane.

The Z-closure member 20 is best seen in FIGS. 3-10 and is formed by bending a single sheet of metal into the configuration shown, which includes retention features that secure a filter 19 to prevent insects and debris from passing through the Z-closure member 20. The Z-closure member 20 is formed to include an upper horizontal flange 22, a lower horizontal flange 24 and a central vertical member 25 interconnecting the upper and lower flanges 22, 24. The central vertical member 25 is preferably formed with a plurality of ventilation openings 26 to permit the passage of air through the Z-closure member 20. The specific shape of the ventilation openings 26 are shown to be an oval configuration; however, one of ordinary skill in the art will recognize that many other shapes for the ventilation openings 26 can be utilized, including round or other geometric shapes.

The Z-closure member is uniquely formed through sheet metal bending techniques to have an upper tab member 28 extending from the upper horizontal flange 22 that secures an upper portion of the filter F, and a lower flexible locking tab 29 extending from the lower horizontal flange to secure a lower portion of the filter F, as will be described in greater detail below, such that the filter F is secured in position adjacent the rear face of the central vertical member 25 to filter the air passing through the ventilation openings 26.

Beginning at the uppermost edge of the central member 25, the upper flange 22 is bent at approximately a 90 degree angle to extend forwardly from the front face of the central member 25 to the terminus of the upper flange 22. The Z-closure member 20 then bends through approximately 180 degrees to create an upper retainer member 27 that doubles back over the upper flange 22 and passes rearwardly of the central member 25 to overlie the filter F. The upper tab member 28 is then formed by a downward bend through an angle slightly less than 90 degrees so that the upper tab member 28 will trap the upper portion of the filter F at the bend for the upper tab member 28, but the upper tab member 28 flares rearwardly to facilitate the insertion of the filter F, as will be descried in greater detail below.

Beginning then at the lowermost edge of the central member 25, the lower flange 24 is formed through a rearward bend of approximately 90 degrees so that the Z-closure member 20 extends rearwardly of the central member 25 underneath the filter F to form a lower retainer member 27*a* and the lower flange 24 extending rearwardly of the central member 25 and the filter F. The Z-closure member 20 then does a reverse bend of slightly less than 180 degrees to extend forwardly to form the lower flexible locking tab 29 in a manner that projects upwardly so that the forward terminus of the lower flexible locking tab 29 will engage a lower portion of the filter F, once inserted. The flexible lower locking tab 29 has a slight range of vertical movement that allows the insertion of the filter F into position against the rearward face of the vertical member 25.

The insertion of the filter F can be easily accomplished by first positioning the upper portion of the filter F against the upper retainer member 27, slipping in front of the upper tab member 28. The rearward inclination of the upper tab member 28 allows the filter F to be angled into position against the upper retainer member 27. Once oriented into the upper portion of the Z-closure member 20 against the upper retainer member 27, the lower portion of the filter F can be pressed toward the vertical member 25 by deflecting the lower locking tab 29 downwardly to permit the filter F to pass into position against the lower retainer member 27*a*. Once the filter F is located past the flexible lower locking tab 29, the lower locking tab 29 will deflect upwardly to engage the lower portion of the filter F. Thus, the filter F is secured into position against the rear face of the vertical member 25 by the upper tab member 28 and the lower locking tab 29 without requiring the use of special fasteners or special formed retainer members such as disclosed in U.S. Pat. No. 5,605,022. One skilled in the art will recognize that the filter F can be installed on the Z-closure member 20 during the time of manufacture of the Z-closure member 20, or at the time of installation of the Z-closure member to connect a vent cap 15 to a roof system 10, as is described below.

The Z-closure member 20 is utilized to secure a vent cap 15 to the roof panels 12 of a raised seam roof system 10. With reference to FIGS. 1 and 2, one skilled in the art will recognize that the Z-closure member 20, as described above, can be secured to the central planar portion of a roof panel 12 between the upright legs 13 thereof by fasteners 14 passing through the lower locking tab 29 and the lower horizontal flange 24. Typically, the Z-closure member 20 is first secured to the roof panels 12 before the vent cap 15 is installed. By connecting the Z-closure members 20 at the same location along the respective roof panels 12, the upper flanges 22 of the respective Z-closure members 20 will be aligned on opposing sides of the peak of the roof 10. As best seen in FIG. 1, the Z-closure member 20 is oriented with the front face of the vertical member 25 facing downwardly toward the exterior of the roof system 10 with the lower flange being directed toward the peak of the roof system 10 and the upper flange being oriented away from the roof peak.

Once the roof panels 12 have been installed with the Z-closure members 20 attached as described above, the vent cap 15 can be installed. The vent cap 15 is formed with a return lip 16 on both opposing sides thereof to define a receiving slot 17. The vent cap 15 can then be installed by sliding the vent cap 15 onto the upper flange 22, positioned within the receiving slot 17. Once mounted onto the upper flanges 22, the vent cap can be fixed into position be inserting a fastener 18, such as a rivet, through the vent cap 15 into engagement with the upper flange 22. Because of the engagement of the vent cap 15 onto the upper flanges 22 of the Z-closure members 20, the vent cap 15 does not require many fasteners 18 to fix the vent cap 15 on the roof system 10. In fact, two fasteners 18 per roof panel 12 have been found to be sufficient to retain the position of the vent cap on the Z-closure members 20.

The Z-closure members 20 are configured to engage with raised seam roof panels 12 and to present an upper flange 22 above the seam of co-joined panels 12 that permits the mounting of a simple vent cap 15 onto the upper flanges 22 of the respective Z-closure members 20 along the line of the roof peak. The simple vent cap 15 can be formed by a single bend at the center of the vent cap 15, along with the opposing bends to form the return lip 16 and the receiving slot 17, as opposed to a more complex vent cap, such as shown in U.S. Pat. Nos. 5,427,571 and 5,605,022, that creates a raised vent cap body to permit the flow of air through the corresponding closure member and into the vent cap. The Z-closure member 20 according to the instant invention allows a flow of air through the central member 25 in flow communication with the vent cap 15 without requiring a raised portion to be formed in the vent cap 15. Thus, the use of the Z-closure 20 with the simple vent cap 15 reduces the costs of installing a raised seam roof system 10.

Figure 17:
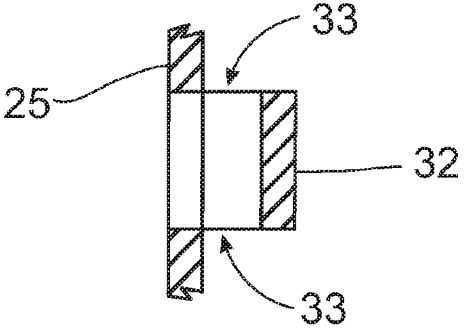
FIG. 17 is an enlarged cross-sectional view of one of the ventilation openings corresponding to lines A-A of FIG. 16.
Figure 12:
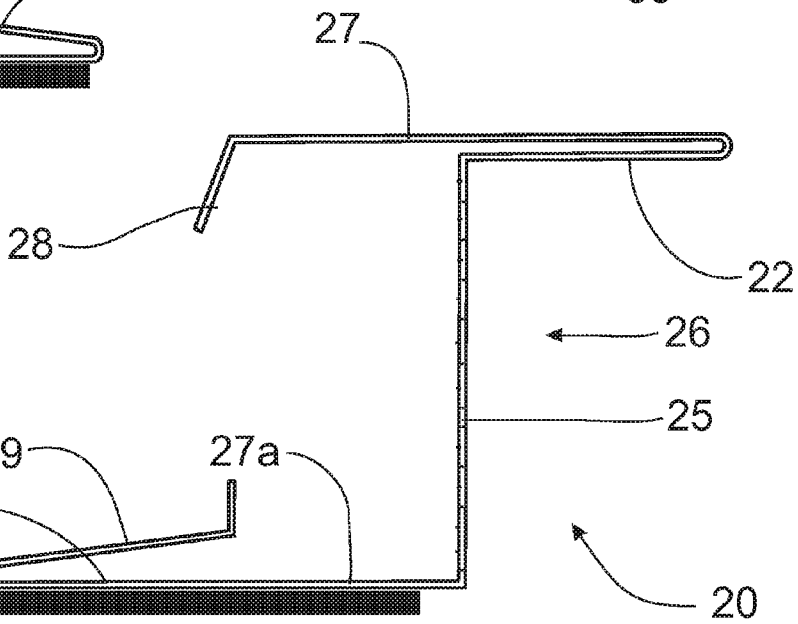
FIG. 12 is a schematic opposing right end elevational view of the second embodiment of the Z-closure member shown in FIG. 11 without the representative filter.
Figure 11:
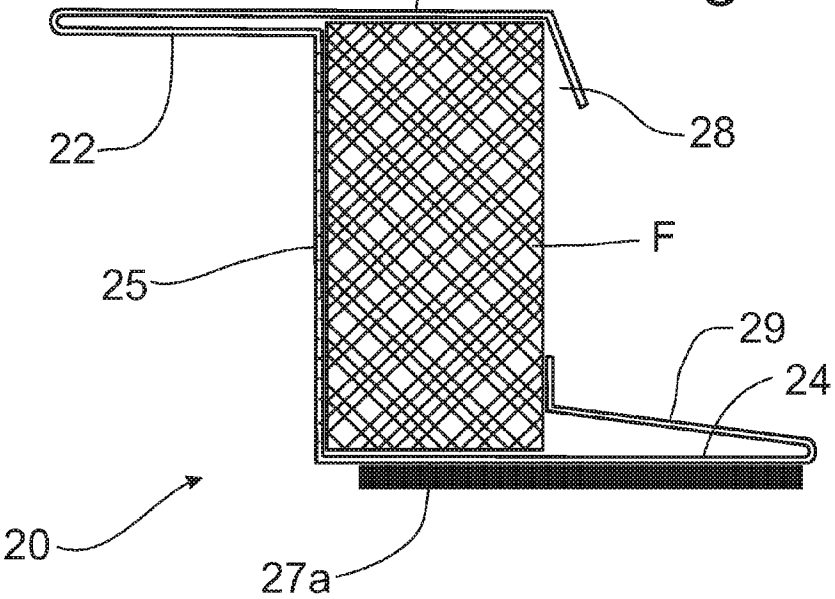
FIG. 11 is a schematic left elevational view of a second embodiment of the Z-closure member incorporating the principles of the instant invention, a representative filter secured by the retention features of the Z-closure member being depicted.
Figure 13:
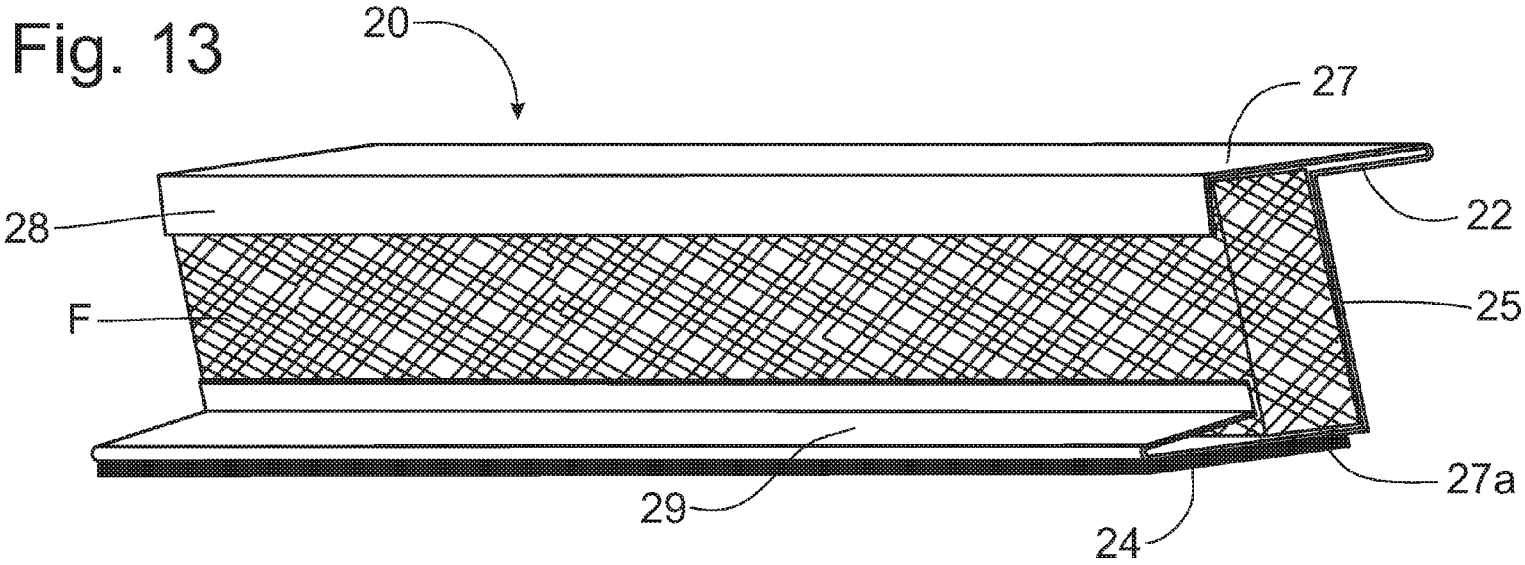
FIG. 13 is a schematic rear perspective view of the second embodiment of the Z-closure member shown in FIG. 11 with a representative filter being depicted.
Figure 14:
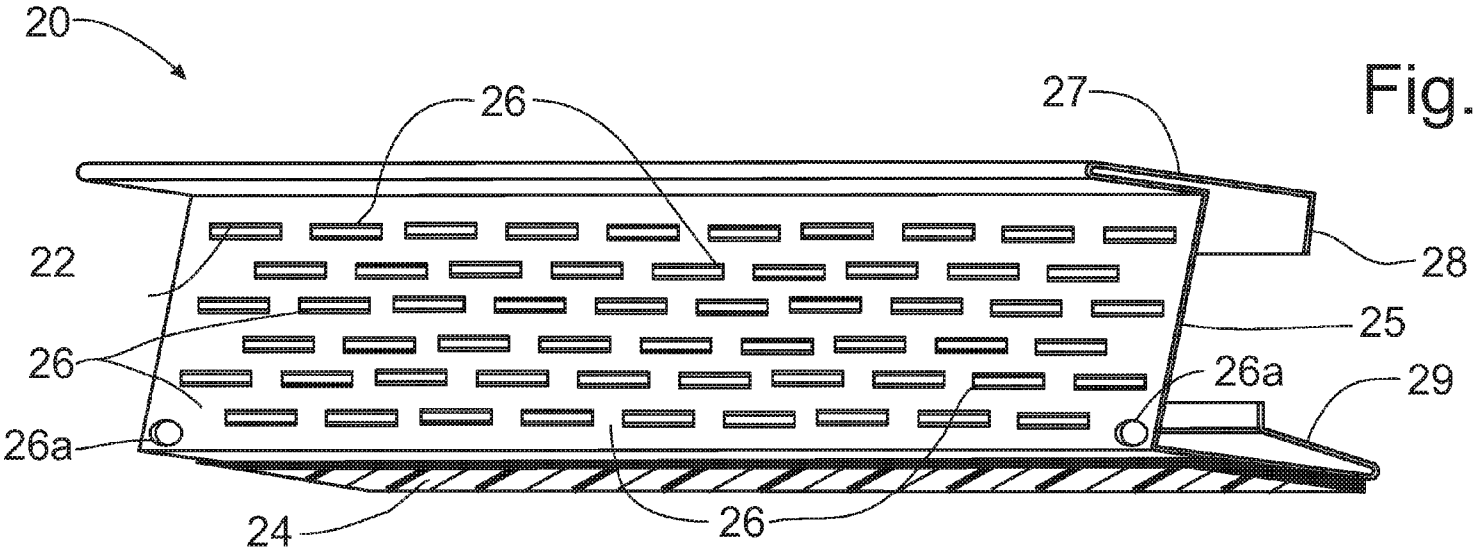
FIG. 14 is a schematic front perspective view of the second embodiment of the Z-closure member shown in FIG. 11 without a representative filter.
Figure 15:
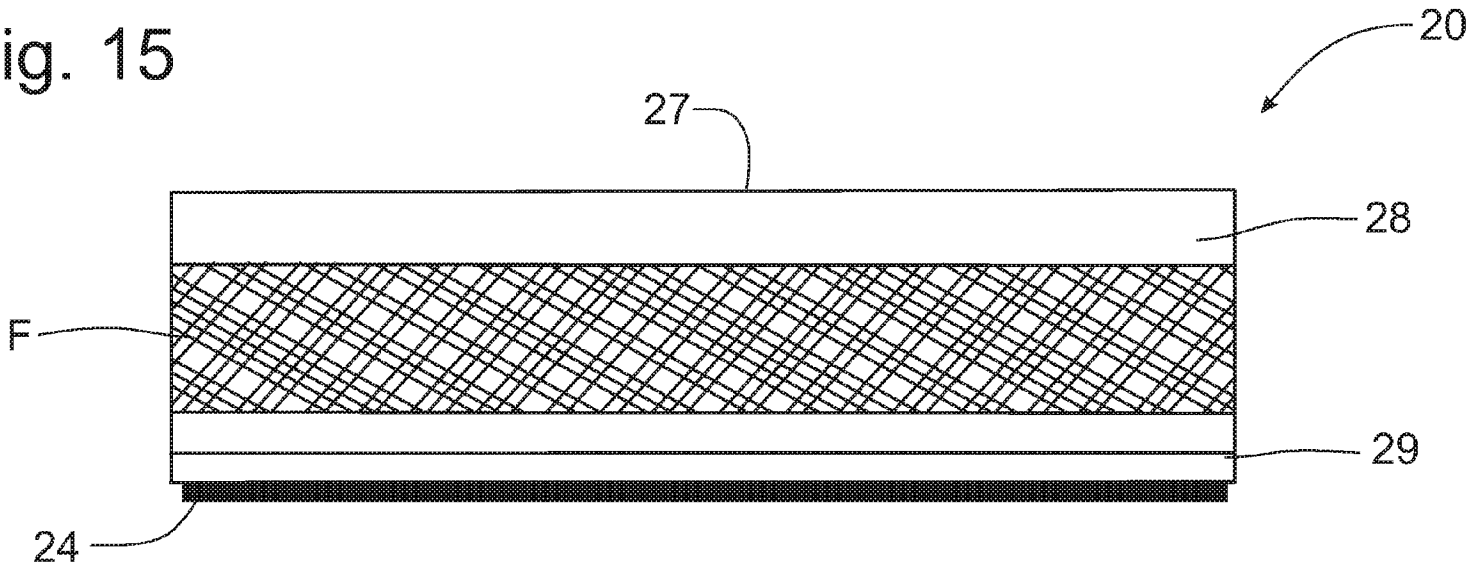
FIG. 15 is a schematic rear elevational view of the second embodiment of the Z-closure member shown in FIG. 11 including a representative filter secured by the retention features of the Z-closure member.
Figure 16:
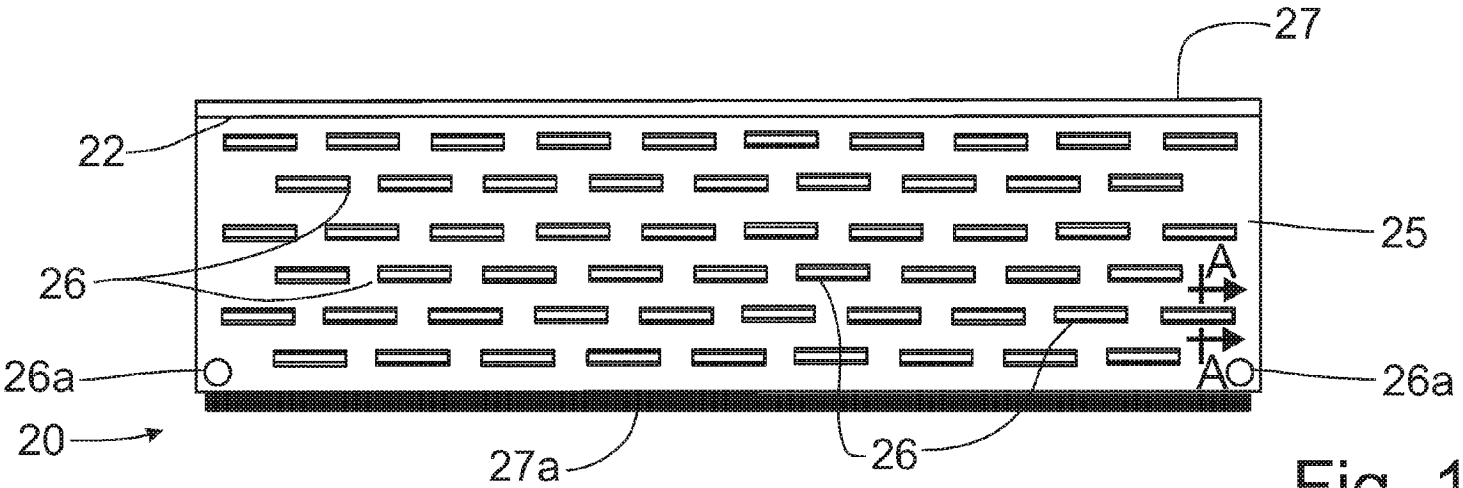
FIG. 16 is a schematic front elevational view of the second embodiment of the Z-closure member shown in FIG. 11.

A second embodiment of the Z-closure member 20 according to the principles of the instant invention is depicted in FIGS. 11-17. The overall configuration is substantially identical to the first embodiment of the Z-closure member 20 depicted in FIGS. 3-10, except for a few additional features added. An optional lower tab member **28*a* is added to the lower flexible locking tab 29 to provide additional engagement with the filter F to assist in retaining the filter F in place against the central vertical member 25. An alternative configuration for the ventilation openings 26 is also shown. This particular configuration shown in FIGS. 14, 16 and 17 is commonly referred to as a "basket weave" opening and is formed by piercing along the top and/or bottom edges of the opening 26 to retain the strip 32 of metal in the center of the opening 26 which is bent inwardly to provide small ventilation openings 33 along the center strip of metal vertically above and below the center strip 32. This center strip 32 of metal allows the opening 26 to be more resistant to the entry of rain water than the punched holes 26. Yet another configuration of the ventilation openings 26 is a louvered opening (not shown) in which metal is pierced along one horizontal top or bottom side and the central portion is bent accordingly to open the pierced side into an opening. The bent portion can be bent inwardly or outwardly as desired to provide air ventilation through the central member 25** while restricting entry of rain water.

This second embodiment of the Z-closure member 20 shown in FIGS. 11-16 also includes an optional elastomeric strip 30 to seal the lower flange 24 against the roof panel 12, particularly the screws 14 that connect the Z-closure member 20 to the roof panel 12. Preferably, the elastomeric strip 30 is positioned only along the bottom portion of the lower flange 24 corresponding to the flexible locking tab 29 so that the elastomeric strip 30 will not be readily seen once the Z-closure member 20 is installed on a roofing panel 12. The elastomeric strip 30 will extend along the entire length of the lower flange 24 so as to extend from one upright leg 13 to the other upright leg 13 on the raised seam roofing panel 12. With the fasteners 14 passing through the flexible locking tab 29 and the upper flange 24 through the elastomeric strip 30 and into the body portion of the roofing panel 12, the elastomeric strip will seal the holes through the Z-closure member 20 and the roofing panel 12 and prevent the passage of rain water through the screw holes into the structure covered by the roofing panels 12.

Under certain wind and rain conditions, such as extremely high winds and rain carried thereby into the ventilated face of the central vertical member 25, slight amounts of rain water can pass through the ventilation openings 26, irrespective of the shape of configuration of the openings 26. Such rain infiltration will be halted by the mesh filter F and settle to the bottom of the filter F against the bottom of the Z-closure member 20. The placement of weep holes **26*a* along the bottom of the central vertical member 25 will enable the collected infiltration of rainwater to drain from the Z-closure member once the rainfall has ceased. Weep holes 26*a* are shown at the opposing edges of the Z-closure member 20, but additional weep holes 26*a* can be added, if necessary, particularly at the center of the bottom of the central vertical member 25**.

Figure 18:
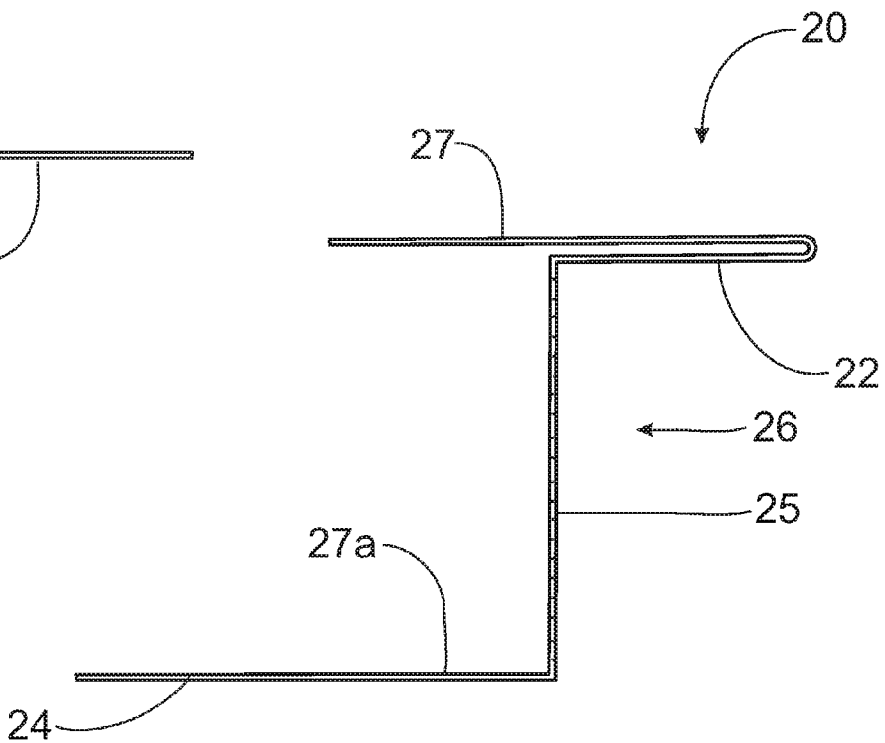
FIG. 18 is a schematic left elevational view of a third embodiment of the Z-closure member incorporating the principles of the instant invention, a representative filter secured by adhesive being depicted.
Figure 19:
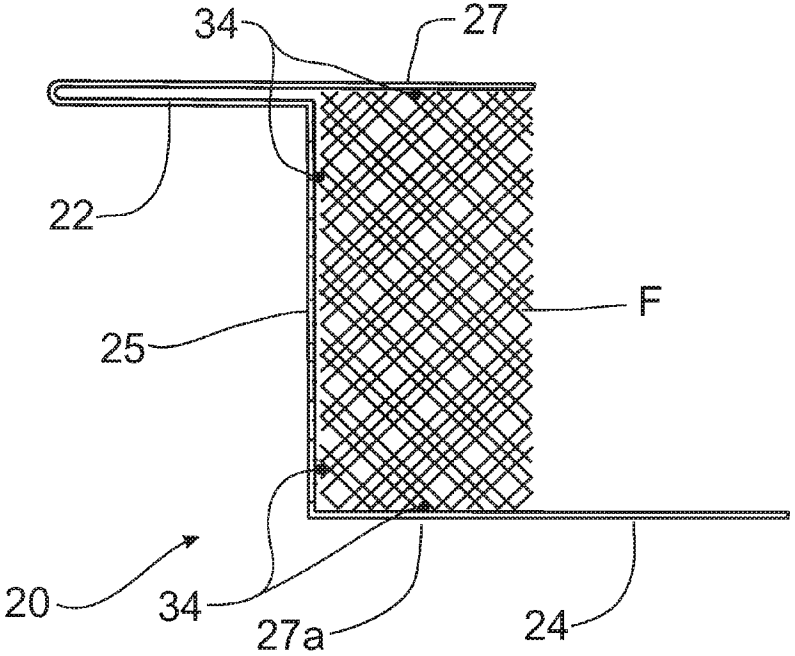
FIG. 19 is a schematic opposing right end elevational view of the third embodiment of the Z-closure member shown in FIG. 18 without the representative filter.

FIGS. 18 and 19 reflect a third embodiment of the Z-closure member incorporating the principles of the instant invention. As compared to the structure of the previous embodiments, the Z-closure member 20 is missing the upper tab member 28 and the lower flexible locking tab 29 that restrain the filter F from moving away from the central member 25. To restrain the filter from moving, the upper retention member 27, and lower retention member **27*a*, as well as one or two places on the central member 25 have applied thereto adhesive 34 that will secure the filter F to the respective upper and lower retention members 27, 27*a*, and the central member. Preferably, the adhesive 34 would be applied at several spots along the length of the Z-closure member 20** to properly secure the filter F.

This third embodiment of the Z-closure member 20 is more economical to manufacture as the progressive bends to the sheet metal to form the upper tab member 28 and the flexible lower locking tab 29 are not required, thus providing an economy version of the Z-closure member 20. The operation of this third embodiment of the Z-closure member 20 is essentially the same as described above except that the filter is not restrained from movement by the missing tabs 28, 29. The weep holes 26*a*, as shown in FIGS. 14 and 16, are preferably used as well to drain out any possible moisture that might pass through the ventilation openings 26 in the central member 25.

Figures 20, 21:
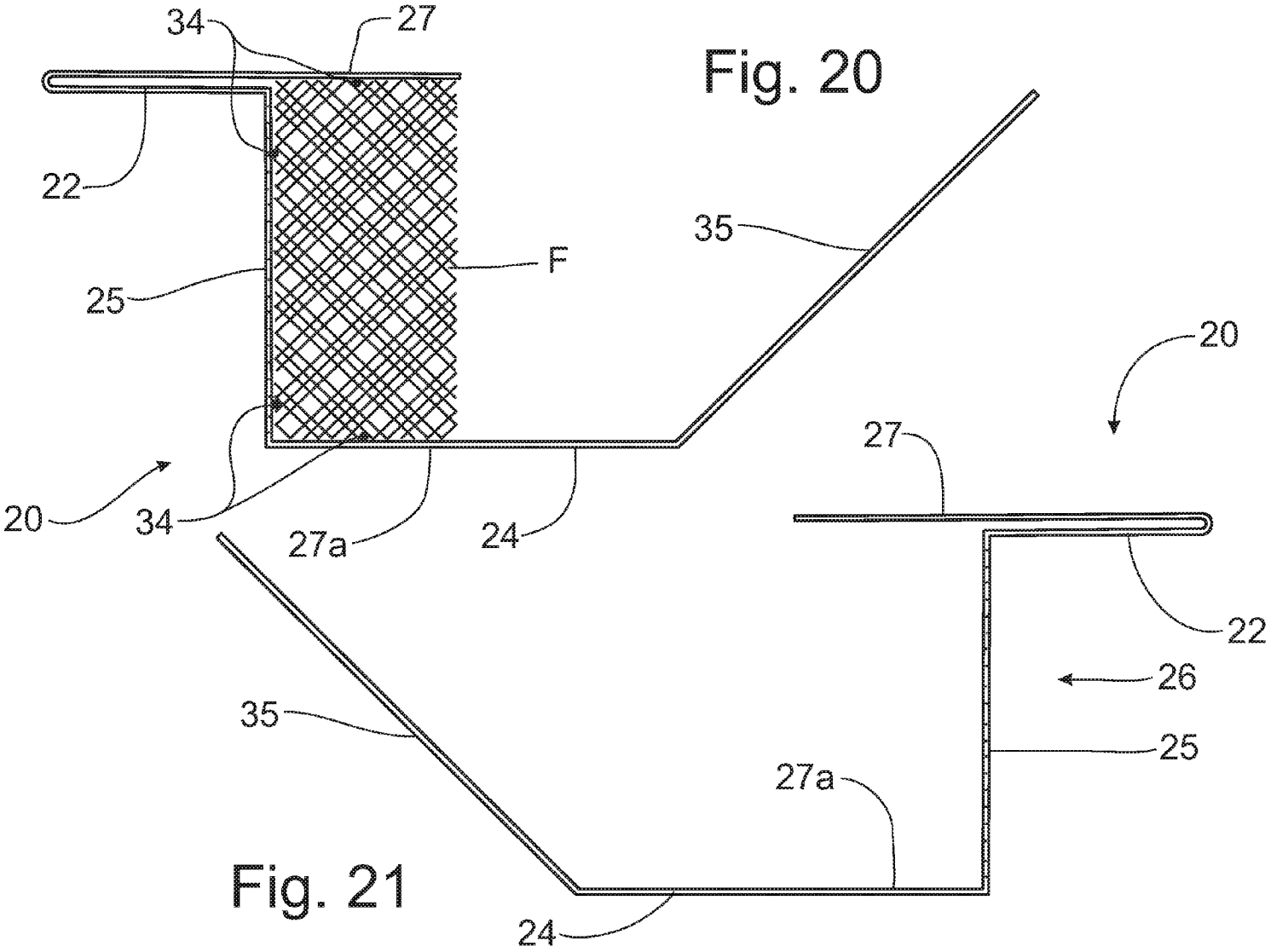
FIG. 20 is a schematic left elevational view of a fourth embodiment of the Z-closure member incorporating the principles of the instant invention, a representative filter secured by adhesive being depicted.
FIG. 21 is a schematic opposing right end elevational view of the fourth embodiment of the Z-closure member shown in FIG. 20 without the representative filter.
Figures 26, 27:
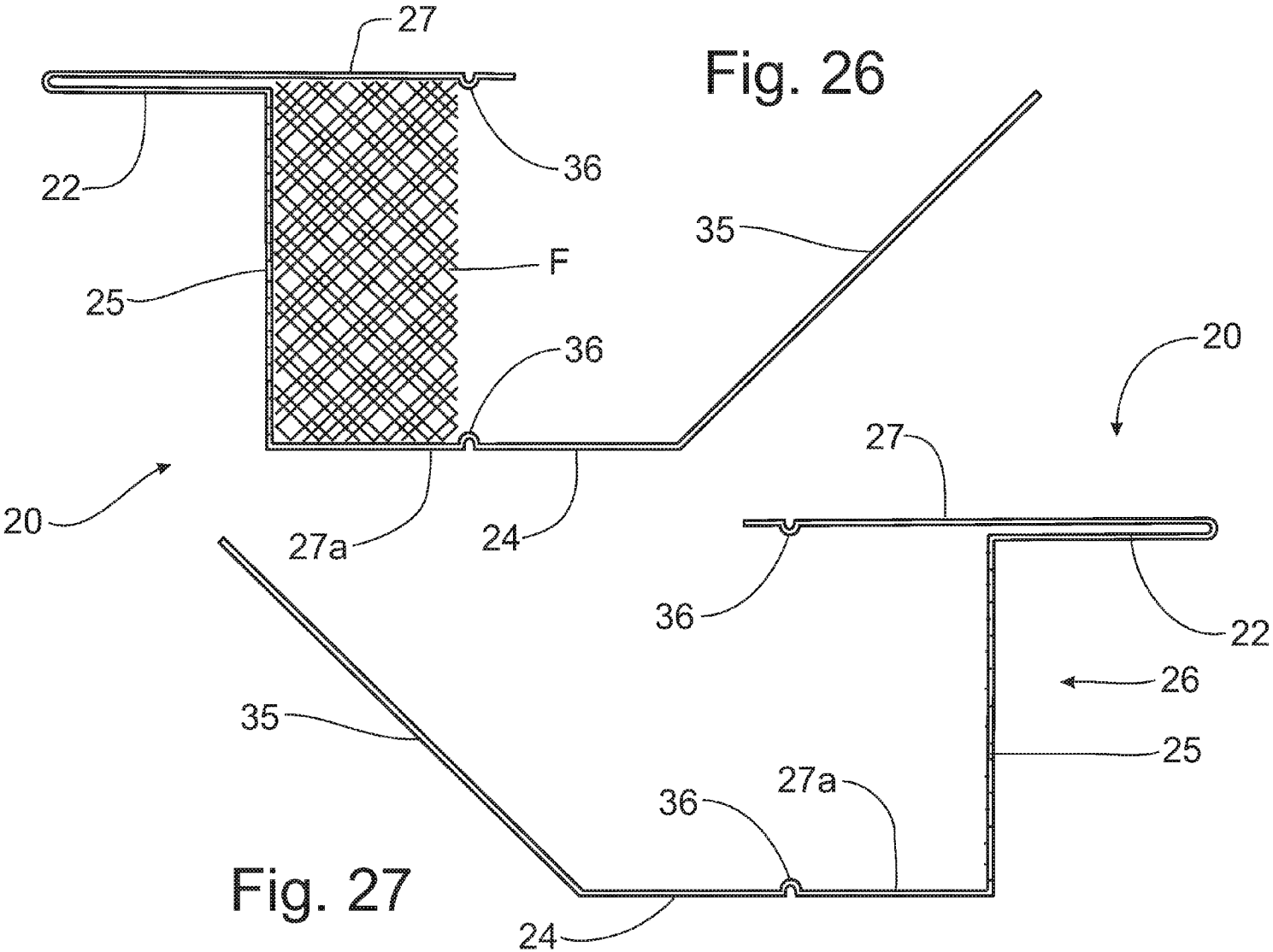
FIG. 26 is a schematic left elevational view of a seventh embodiment of the Z-closure member incorporating the principles of the instant invention, a representative filter secured by retention features of the closure member being depicted.
FIG. 27 is a schematic opposing right end elevational view of the seventh embodiment of the Z-closure member shown in FIG. 26 without the representative filter.

Referring now to FIGS. 20 and 21, a fourth embodiment of the Z-closure member 20 incorporating the principles of the instant invention can best be seen. As compared with the third embodiment described above, the fourth embodiment incorporates a deflector panel 35 at the distal end of the lower flange 24. In events of heavy rain and wind that might blow moisture through the ventilation openings 26 in the central panel 25 and also through the filter F, the deflector panel 35 will force the moisture laden air upwardly toward the vent cap 15, as is depicted in FIG. 26, to allow any moisture to drop out from the air flow and roll back down the deflector panel 35 and lower horizontal flange 24 to be drained from the Z-closure member 20 through the weep holes 26*a*, as shown in FIGS. 14 and 16. As with the third embodiment depicted in FIGS. 18 and 19, the Z-closure member is not formed with specific locking tabs that restrain the filter F from moving away from the central member 25. Accordingly, adhesive 34 is applied along the length of the Z-closure member 20, as described above, to secure the positioning of the filter F relative to the central member 25.

Figures 22, 23:
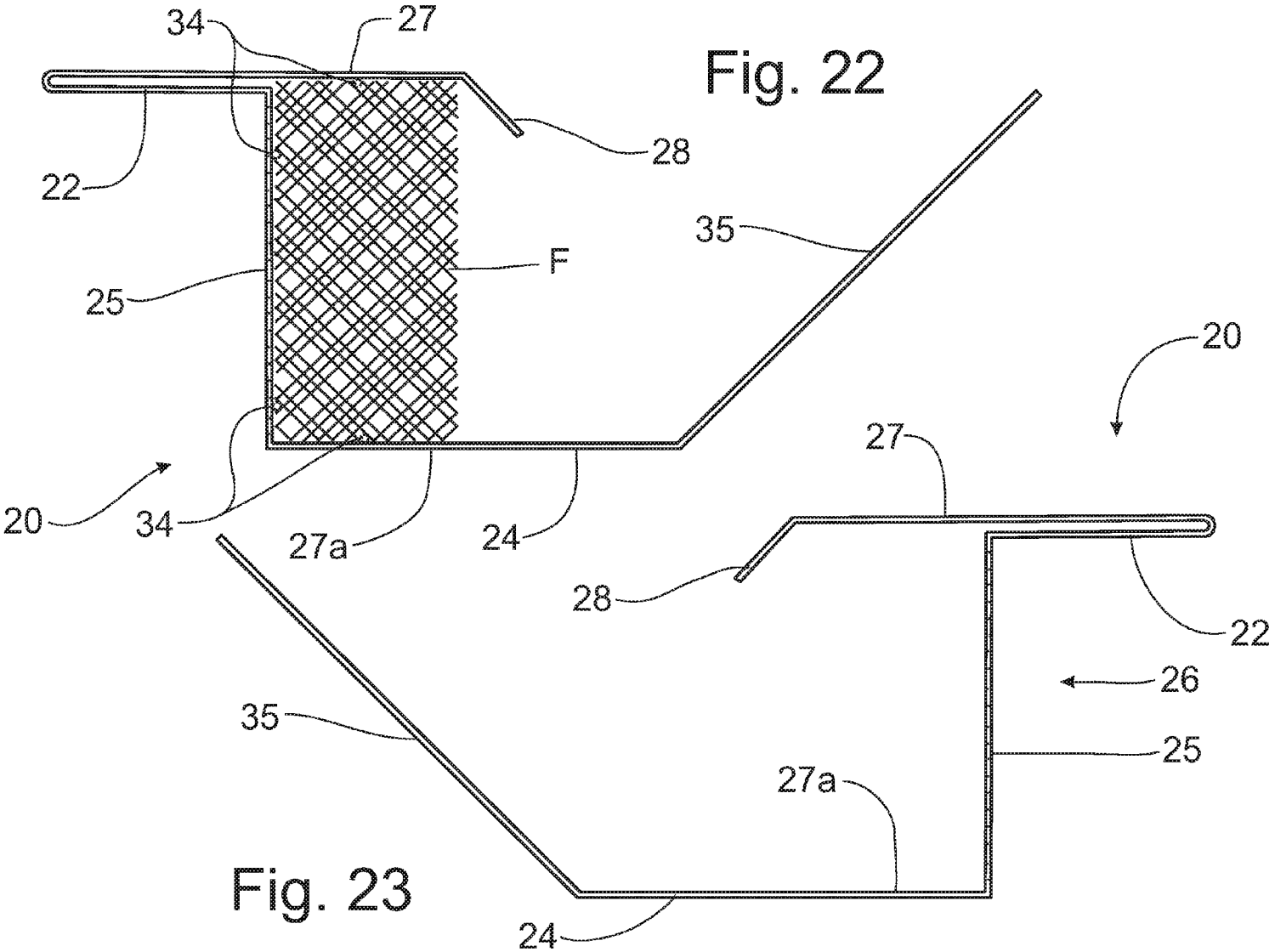
FIG. 22 is a schematic left elevational view of a fifth embodiment of the Z-closure member incorporating the principles of the instant invention, a representative filter secured by a retention flange and/or adhesive being depicted.
FIG. 23 is a schematic opposing right end elevational view of the fifth embodiment of the Z-closure member shown in FIG. 22 without the representative filter.
Figures 24, 25:
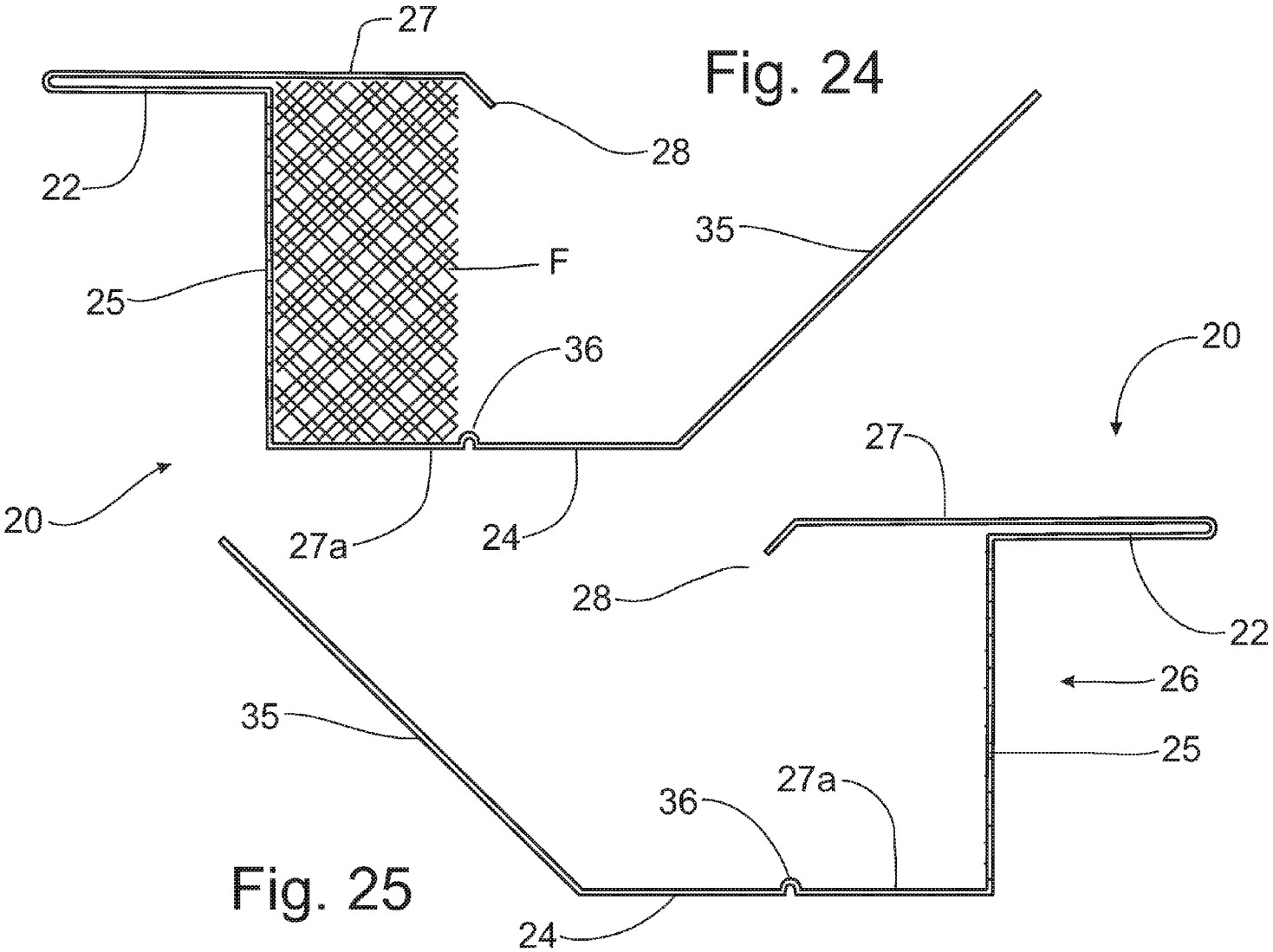
FIG. 24 is a schematic left elevational view of a sixth embodiment of the Z-closure member incorporating the principles of the instant invention, a representative filter secured by retention features of the closure member being depicted.
FIG. 25 is a schematic opposing right end elevational view of the sixth embodiment of the Z-closure member shown in FIG. 24 without the representative filter.

Referring now to FIGS. 22 and 23, a fifth embodiment of the Z-closure member 20 incorporating the principles of the instant invention can best be seen. Compared to the fourth embodiment depicted in FIGS. 20 and 21, the fifth embodiment of the Z-closure member 20 has an upper tab member 28 added to help retain the positioning of the filter F against the central member 25. The upper tab member 28 can keep the filter F from moving completely away from the central member 25, but due to the flexibility of some filter F configurations, the bottom portion of the filter F might push rearwardly away from the corresponding surface of the central member. Accordingly, adhesive 34 can be provided optionally to further restrain the filter F from moving rearwardly.

Figure 28:
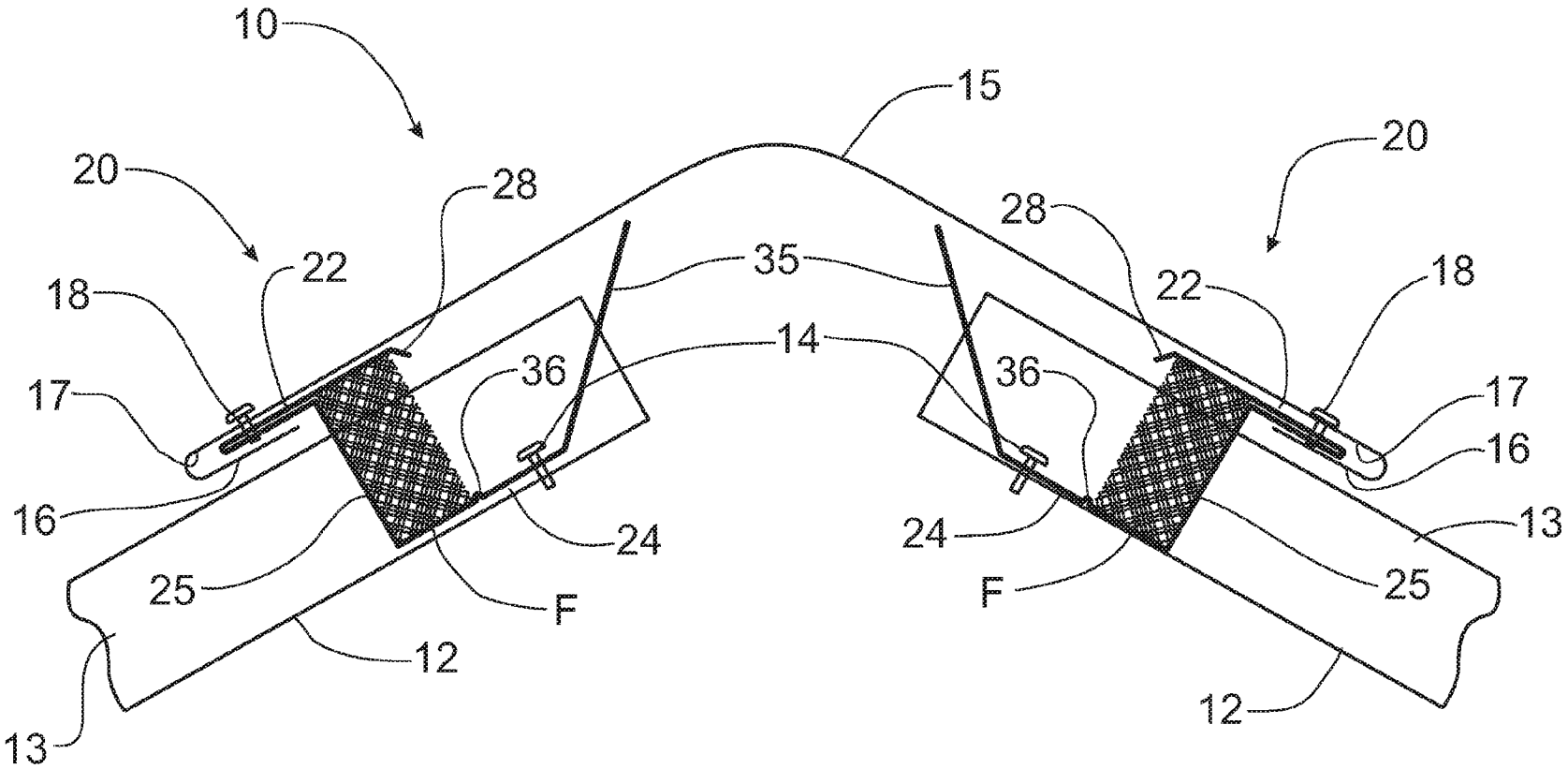
FIG. 28 is a schematic cross-sectional view of a vent cap mounted on a raised seam roof structure by the sixth embodiment of the Z-closure members incorporating the principles of the instant invention.

Referring now to FIGS. 24-28, sixth and seventh embodiments of the Z-closure member 20 incorporating the principles of the instant invention can best be seen. Compared to the fifth embodiment described above, the lower horizontal flange 24 in the sixth embodiment is formed with a dimple 36 that is pressed upwardly toward the upper tab member 28. The combination of the upper tab member 28 and the dimple 36 (along with gravity when the Z-closure member is installed, as is represented in FIG. 28) is effective to retain the filter F in position against the central member 25. The formation of the deflector member 35 would be an optional feature for the Z-closure member 20, as the sixth embodiment depicted in FIGS. 24, 25 and 28 without the deflector member 35 would be the equivalent of the first embodiment described above with the dimple 36 replacing the formation of the lower flexible locking tab 29 that is cumbersome to form during the manufacturing process.

The seventh embodiment of the Z-closure member 20 incorporating the principles of the instant invention is depicted in FIGS. 26 and 27. Compared to the sixth embodiment described above, the upper retaining member 27 is also formed with a dimple 36 that is pressed downwardly toward the lower flange 24. The combination of the two dimples 36 (along with gravity when the Z-closure member is installed, as is represented in FIG. 28) is effective to retain the filter F in position against the central member 25. AS noted previously, the formation of the deflector member 35 would be an optional feature for the Z-closure member 20, as the seventh embodiment depicted in FIGS. 26-27 without the deflector member 35 would also be the equivalent of the first embodiment described above with the lower dimple 36 replacing the formation of the lower flexible locking tab 29 that is cumbersome to form during the manufacturing process and the upper dimple 36 replacing the upper tab.

The installation of the sixth embodiment to connect a vent cap 15 to a raised seam roofing structure 10 is shown in FIG. 26. As with the installation of the first embodiment depicted in FIGS. 1 and 2, the Z-closure member is attached to the vent cap 15 by a fastener 18 that interconnects the vent cap 15 and the upper flange member 22, and by a fastener 14 connecting the lower flange member 24 to the roof panel 12. The optional deflector member 35 extends upwardly and rearwardly from the lower flange member 24 to terminate at a distal end spaced slightly from the vent cap 15 to allow the passage of air between the vent cap 15 and the central member 25 through the filter F. If the deflector member 35 is not incorporated into the Z-closure member 20, the entire space between the vent cap 15 and the roof panel 12 will permit the passage of air through the filter F retained by the upper tab member 28 and the dimple 36.

As noted above, the filter F is a preferable option to limit the entrance of insects and dirt through the ventilation openings 26 in the central member 25. However, the filter F, if utilized, may be inserted onto the Z-closure member 20 during the manufacturing process that forms the Z-closure member 20, or the filter F could be added to the Z-closure member 20 at the time of installation of the Z-closure member 20 to mount the vent cap 15 to the roofing structure 10. This option of inserting the filter F at the time of installation is also appropriate in the embodiments described above where adhesive 34 is restraining the filter F from movement relative to the central member 25, although one skilled in the art will note that adhesive restrained filters F are more efficiently installed at the time of manufacture than at the time of installation.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. A Z-shaped closure member for mounting a vent cap on a raised seam roof structure, comprising:

a central member having a front face and a rear face, said central member having ventilation openings formed therein for the passage of air through said central member;

an upper flange integral with said central member and extending forwardly from an upper end of said front face approximately orthogonally thereto;

an upper retainer member integrally formed with said upper flange and extending from a front terminus of said upper flange in an overlying manner relative thereto to a position spaced a predetermined distance rearwardly of the rear face of said central member;

a lower flange integral with said central member and extending rearwardly in an opposing direction relative to said upper flange from a lower end of said front face approximately orthogonally thereto, said upper retainer member, said central member and said lower flange defining a cavity for the insertion of a filter; and filter retention devices incorporated into said upper and lower flanges to restrain movement of said filter away from said central member when said filter is installed in said cavity.

2. The Z-shaped closure member of claim 1 wherein said retention devices include adhesive placed on one or more of said upper retainer member, said central member and said lower flange for engagement with said filter when installed in said cavity.

3. The Z-shaped closure member of claim 1 wherein said retention devices include an upper tab member integrally formed with said upper retainer member and extending downwardly therefrom and terminating below said upper retainer member and rearwardly of said cavity.

4. The Z-shaped closure member of claim 3 wherein said retention devices include a flexible locking tab integrally formed with said lower flange and extending forwardly from a rear terminus of said lower flange and terminating rearwardly of said cavity.

5. The Z-shaped closure member of claim 3 wherein said retention devices include a retention dimple formed into said lower flange and projecting upwardly toward said upper retainer member and being located adjacent said cavity, such that said filter when installed into said cavity is retained in positioned relative to said central member by said retention dimple and said upper tab member.

6. The Z-shaped closure member of claim 3 wherein said upper tab is formed as a retention dimple projecting downwardly toward said lower flange and being located adjacent said cavity.

7. The Z-shaped closure member of claim 1 further comprising a deflection member integrally formed with said lower flange and extending rearwardly and upwardly from a lower terminus of said lower flange.

8. The Z-shaped closure member of claim 7 wherein said deflection member terminates below a plane defined by said upper retainer member so that a gap is defined between a distal terminus of said deflection member and said vent cap when said Z-shaped closure member is installed to connect said vent cap to said raised seam roof structure.

9. The Z-shaped closure member of claim 1 wherein said central member is formed with weep holes to allow the passage of moisture from rearwardly of said central member.

10. The Z-shaped closure member of claim 9 wherein said lower flange includes a seal member mounted thereon and being positioned on a lower side of said lower flange opposite from said cavity.

11. The Z-shaped closure member of claim 10 wherein said seal member is formed of elastomeric material and is extends along the lower side of said lower flange for a distance substantially equal to a length dimension of said cavity.

12. A Z-shaped closure member for mounting a vent cap on a raised seam roof structure, comprising:

a central member having a front face and a rear face and being formed with ventilation openings;

an upper flange integral with said central member and extending forwardly from an upper end of said front face approximately orthogonally thereto;

an upper retainer member integrally formed with said upper flange and extending from a front terminus of said upper flange in an overlying manner relative thereto to a position spaced a predetermined distance rearwardly of the rear face of said central member;

a lower flange integral with said central member and extending rearwardly in a direction opposite from said upper flange from a lower end of said front face approximately orthogonally thereto, said upper retainer member, said central member and said lower flange defining a cavity for the insertion of a filter;

filter retention devices incorporated into said upper and lower flanges to restrain movement of said filter away from said central member when installed in said cavity; and a filter positioned within said cavity adjacent the rear face of said central member, said filter being retained in position against said rear face by said filter retention devices.

13. The Z-shaped closure member of claim 12 further comprising a deflection member integrally formed with said lower flange and extending rearwardly and upwardly from a lower terminus of said lower flange.

14. The Z-shaped closure member of claim 12 wherein said lower flange includes an elastomeric seal member mounted thereon and being positioned on a lower side of said lower flange opposite from said cavity, said seal member extending along the lower side of said lower flange for a distance substantially equal to and corresponding to a length dimension of said locking tab.

15. The Z-shaped closure member of claim 12 wherein said central member is formed with weep holes adjacent said lower flange to permit passage of moisture from rearwardly of said central member, said ventilation openings being formed with vertically oriented slots and a central strip bent from said central member.

16. The Z-shaped closure member of claim 15 wherein said retention devices include adhesive placed on one or more of said upper retainer member, said central member and said lower flange for engagement with said filter.

17. The Z-shaped closure member of claim 15 wherein said retention devices include an upper tab member integrally formed with said upper retainer member and extending downwardly therefrom and terminating below said upper retainer member and rearwardly of said cavity.

18. The Z-shaped closure member of claim 17 wherein said retention devices include a flexible locking tab integrally formed with said lower flange and extending forwardly from a rear terminus of said lower flange and terminating rearwardly of said cavity.

19. The Z-shaped closure member of claim 17 wherein said retention devices include a retention dimple formed into said lower flange and projecting upwardly toward said upper retainer member and being located adjacent said cavity, such that said filter when installed into said cavity is retained in positioned relative to said central member by said retention dimple and said upper tab member.

20. The Z-shaped closure member of claim 19 further comprising a deflection member integrally formed with said lower flange and extending rearwardly and upwardly from a lower terminus of said lower flange.

* * * * *